US007343892B2

(12) United States Patent
Kunc

(10) Patent No.: US 7,343,892 B2
(45) Date of Patent: Mar. 18, 2008

(54) AIR-COOLED DIESEL OUTBOARD MOTOR

(76) Inventor: Boris Kunc, Medvedova ulica 14, Ljubljana (SI) 1000

( * ) Notice: Subject to any disclaimer, the term of this patent is extended or adjusted under 35 U.S.C. 154(b) by 0 days.

(21) Appl. No.: 11/265,522

(22) Filed: Nov. 2, 2005

(65) Prior Publication Data

US 2006/0211316 A1 Sep. 21, 2006

Related U.S. Application Data

(63) Continuation-in-part of application No. 10/499,488, filed as application No. PCT/SI02/00028 on Dec. 11, 2002, now abandoned.

(51) Int. Cl.
*F02B 61/04* (2006.01)
*B63H 21/14* (2006.01)

(52) U.S. Cl. ..... 123/195 R; 123/195 P; 440/89 B

(58) Field of Classification Search ..... 123/195 R, 123/195 P, 196 W; 440/88 C, 89 B
See application file for complete search history.

(56) References Cited

U.S. PATENT DOCUMENTS 2,209,301 A * 7/1940 Johnson et al. ..... 123/195 R
2,943,592 A * 7/1960 Benson et al. ..... 440/78

FOREIGN PATENT DOCUMENTS

JP 60229895 A * 11/1985

* cited by examiner

*Primary Examiner*—Noah P. Kamen
(74) *Attorney, Agent, or Firm*—Watson IP Group, PLC; Jovan N. Jovanovic; Vladan M. Vasiljevic

(57) ABSTRACT

An air-cooled diesel outboard motor comprising an air-cooled diesel engine. The diesel engine includes a vertical crankshaft, an exhausting port and a drive-leg. The drive leg includes a gear-box, a propeller and a water pump in a lower unit, a water cooling exhalation port and a mechanism fastened to the boat. The vertical crankshaft is attached to the drive-leg and an exhalation port of the engine connects to the exhalation port of the drive leg with a water cooled pipe through which the cooling water flows. Propelling power is utilized to push the water into the port.

1 Claim, 2 Drawing Sheets

AIR-COOLED DIESEL OUTBOARD MOTOR

CROSS-REFERENCE TO RELATED APPLICATION

This application is a continuation-in-part of U.S. Ser. No. 10/499,488 filed Jun. 17, 2004 now abandoned which is a §371 of PCT/SI02/00028 filed Dec. 11, 2002, which claims priority from Slovenian Patent Application No. P-200100324 filed Dec. 20, 2001, the entire specification of each is hereby incorporated by reference.

BACKGROUND OF THE INVENTION

1. Field of the Invention

This invention concerns an air-cooled outboard motor for boats with a diesel engine with a vertical crankshaft.

2. Background Art

This invention is a solution to many technical problems. It significantly unburdens the environment, uses less fuel and can even be used in running waters, whereas water-cooled outboard motors are not appropriate to use in some running waters due to high content of sand in such waters.

The known solution of an air-cooled outboard motor is a two-stroke petrol outboard motor, which makes it inappropriate to use in inner waters of some countries due to environmental regulations.

The solution of the diesel outboard motor is shown as an outboard diesel motor which is water-cooled and is because of this heavy in weight (approx. 100 kg). It is for this reason not convenient for smaller boats and for use in sandy waters (for example the river Pad in Northern Italy contains so much sand that the water pumps fail quite fast).

SUMMARY OF THE INVENTION

With this invention the described problem is solved with an air-cooled diesel outboard motor. Its weight is comparable to the weight of petrol outboard motors. The motor is composed of an air-cooled diesel engine with a vertical crankshaft and drive-leg for outboard motors. The drive leg contains a gear-box and water pump in the lower unit, water-cooling exhalation port and fastened mechanism for the boat. Industrial air-cooled diesel engine with a vertical crankshaft is attached to the drive-leg of the outboard motor. The vertical crankshaft along with the gear is connected to the axle. To achieve optimal engine power of the propeller it is required to adequately adjust the gearing ratio in the gearbox in relation to the size or propeller gradient. The exhausting port from the power engine connects to the exhausting port in the drive-leg with a water-cooled pipe through which the cooling-water flows. Cooling-water flowing is regularly created with a junction on the water pump of the lower unit or also without a built-in water pump but by using propelling power to push the water into the port, which is built-in next to the propeller on the lower part of the anticavitation plate.

BRIEF DESCRIPTION OF THE DRAWINGS

The invention will be described with reference to the accompanying drawings, wherein.

DETAILED DESCRIPTION OF THE DRAWINGS

Figure 1:
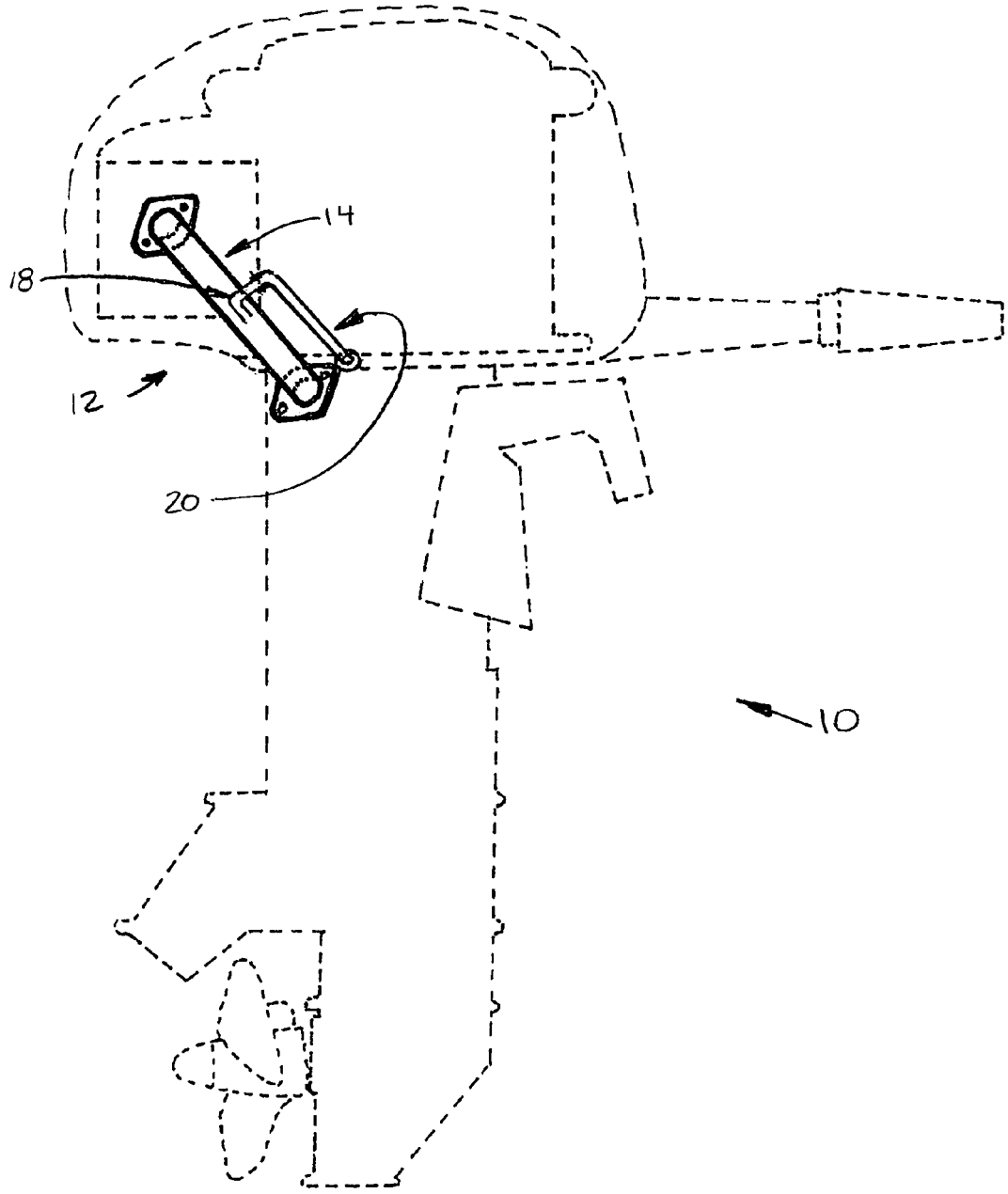
FIG. 1 of the drawings comprises a side elevational view of a portion of the invention.

While this invention is susceptible of embodiment in many different forms, there is shown in the drawings and described herein in detail a specific embodiment with the understanding that the present disclosure is to be considered as an exemplification of the principles of the invention and is not intended to limit the invention to the embodiment illustrated.

Figure 2:
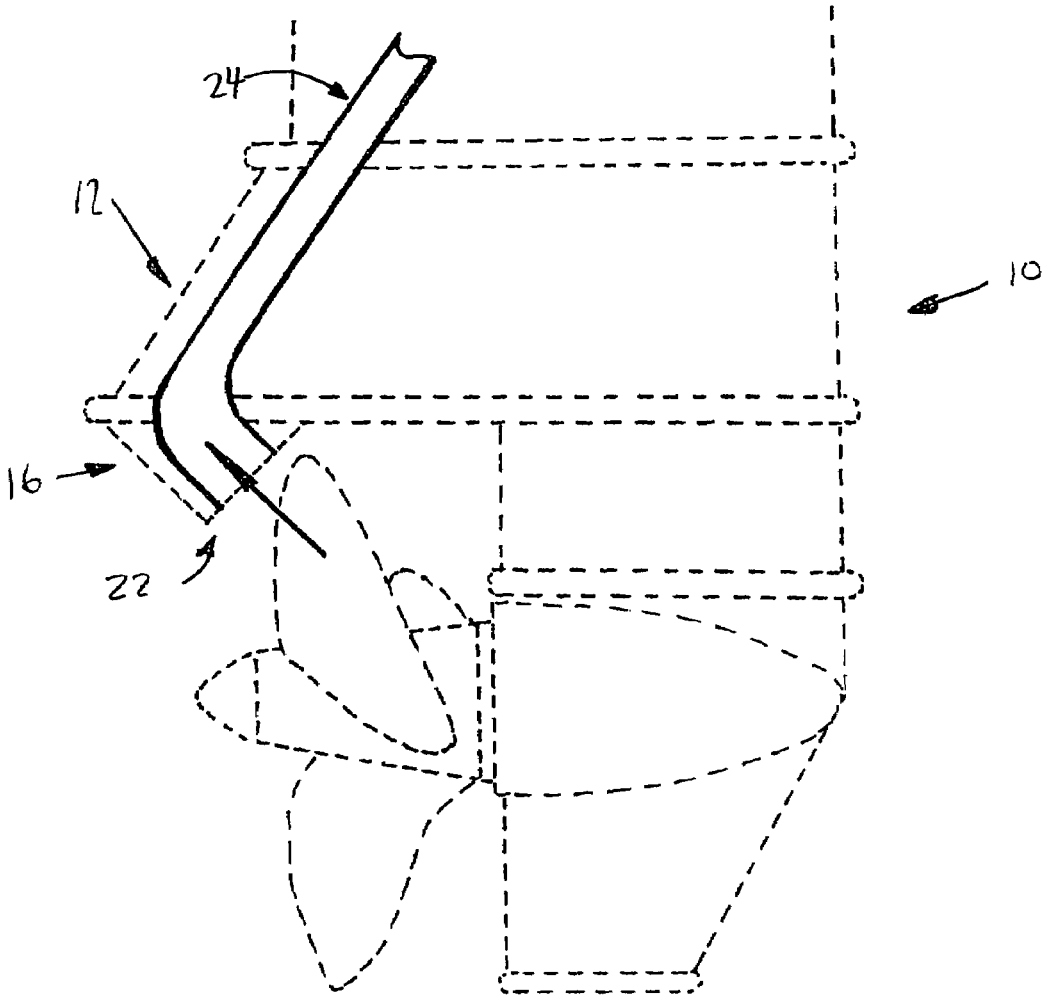
FIG. 2 of the drawings comprises a side elevational view of a portion of the invention.

With reference to FIGS. 1 and 2, the air-cooled diesel outboard motor 10 includes an air-cooled diesel aggregate having a vertical crankshaft (not shown). A drive leg is provided which has a gear-box and a water pump in the lower unit. A water-cooled exhalation system 12 is provided. The exhaust pipe 14 is forcibly cooled by the water propelled by a water pump 16 through the drive leg directed into the upper part of the exhaust pipe 14 nearby engine exhaust port. Optionally, a drive leg for outboard motors with a gear-box and without water pump may be employed. In certain embodiments, a water-cooling exhalation system may be provided, where the exhaust pipe is not forcibly cooled and leaded through the drive leg and out through the propeller. The exhaust pipe has nearby of the exhaust entry a borehole 18, through which is welded the thin angle-pipe 20 oriented in direction of exhaust gases (FIG. 1). The angle pipe enables cooling by a jet of water through the angle-pipe in direction of exhaust gases.

The suction port 22 is located on the lower part of the anticavitation plate after the propeller and is opened against the water stream, as is shown in FIG. 2. The suction port is directly connected with the pipe 24 to the angle pipe 20 in the exhaust system. A special ventilation cowling for entering of cooling air flow that prevents admission of water drops is provided. In particular, angled ventilating holes on the vertical sides of the special ventilation cowling are in the inner side of the cover oriented upwards.

Attachment can be organized through a hollow unit holding 4 or more boreholes for engine attachment on an upper shell and 6 boreholes for drive-leg attachment on the lower shell and a container in-between for leading exhaust gases into a drive leg.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A cooling system for an air-cooled diesel outboard motor having a propeller and a exhaust pipe, and being coupled to a boat comprising:

a suction port positioned behind the propeller of the air-cooled diesel outboard motor;

a thin angle-pipe extending through a wall of the exhaust pipe so as to be placed in fluid communication with the exhaust pipe of the air-cooled diesel outboard motor, the thin angle pipe having an exhaust in the direction of flow of the exhaust; and a pipe connecting said suction port and said thin angle-pipe so as to place the two in fluid communication, to, in turn, facilitate the direction of water from the suction port through the pipe, the thin angle-pipe and into the exhaust pipe in the direction of flow of exhaust gases, to, in turn, cool same.

* * * * *